US007540754B2

(12) United States Patent
Hankey et al.

(10) Patent No.: US 7,540,754 B2
(45) Date of Patent: Jun. 2, 2009

(54) UNIVERSAL SERIAL BUS PLUG AND SOCKET COUPLING ARRANGEMENTS

(75) Inventors: Evans Hankey, San Francisco, CA (US); Rico Zorkendorfer, San Francisco, CA (US); John Benjamin Filson, San Jose, CA (US); Douglas Joseph Weber, Arcadia, CA (US); Stephen Zadesky, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/933,215

(22) Filed: Oct. 31, 2007

(65) Prior Publication Data

US 2008/0200069 A1 Aug. 21, 2008

Related U.S. Application Data

(62) Division of application No. 11/327,819, filed on Jan. 6, 2006, now Pat. No. 7,384,295.

(51) Int. Cl.
*H01R 13/625* (2006.01)
*H01R 4/50* (2006.01)

(52) U.S. Cl. ..... 439/348

(58) Field of Classification Search ..... 439/348, 439/345, 660, 823, 953
See application file for complete search history.

(56) References Cited

U.S. PATENT DOCUMENTS 4,610,496 A 9/1986 Schwartz et al.
5,658,170 A 8/1997 Tan et al.
5,772,461 A 6/1998 Yu et al.
7,125,273 B2 10/2006 Irwin et al.
7,384,295 B2 6/2008 Hankey et al.

FOREIGN PATENT DOCUMENTS

EP 0738029 A 10/1996
EP 1482601 A 12/2004
JP 2003282178 A 10/2003

OTHER PUBLICATIONS

"Written Opinion", Issue in PCT Applicaton No. PCT/US2006/000427; Mailing Date.: May 12, 2006.
"Non-Final Office Action", U.S. Appl. No. 11/327,819; Correspondence Date: Jun. 19, 2007.
"Non-Final Office Action", U.S. Appl. No. 11/327,819; Correspondence Date: Mar. 2, 2007, 14.
"International Search Report", Issued in PCT Application No. PCT/US2006/000427; Mailing Date: May 12, 2006.

*Primary Examiner*—Javaid Nasri
(74) *Attorney, Agent, or Firm*—IP Strategy Group, P.C.

(57) ABSTRACT

A Universal Serial Bus socket-equipped arrangement (USB-SEA) configured for mating with a Universal Serial Bus (USB) plug having a plug metal housing and an aperture disposed in the plug metal housing. The arrangement includes a plug-receiving cavil configured to receive the USB plug. The arrangement further includes a spring-loaded mechanism disposed within the plug-receiving cavity. The spring-loaded mechanism is biased toward an interior region of the plug-receiving cavity. The spring-loaded mechanism is also configured to slide along the connector metal housing of the USB plug when the USB plug is inserted into the plug-receiving cavity and to movably mate with the aperture disposed in the plug metal housing when the USB plug is in a terminal mating position with the USB socket assembly. The spring-loaded mechanism represents one of a spring-loaded ball and a spring-loaded pin.

4 Claims, 6 Drawing Sheets

UNIVERSAL SERIAL BUS PLUG AND SOCKET COUPLING ARRANGEMENTS

CROSS REFERENCE/PRIORITY CLAIM

This application is a divisional application under 37 CFR 1.53(b) of and claims the benefit under 35 U.S.C. §120 to a commonly assigned patent application entitled "Universal Serial Bus Connector and Socket Coupling Arrangements," by Hankey et al., application Ser. No. 11/327,819 filed on Jan. 6, 2006, issued as U.S. Pat. No. 7,384,295, all of which is incorporated herein by reference.

BACKGROUND OF THE INVENTION

Universal Serial Bus (USB) provides an interface standard for communication between a host and external devices. USB has enjoyed success in the marketplace due to the relatively small form factor of its connectors and its relatively high data throughput rates (particularly for USB v.2.0). Further, USB is highly user-friendly, allowing for plug-and-play connections and hot-swapping capability (i.e., allowing the USB device to be plugged into and removed from a host without requiring the host to be rebooted).

As discussed herein, a USB host typically has a USB socket for coupling with an electronic device (i.e., a USB device) having a corresponding USB plug. Hosts may include, but are not limited to desktop units, laptop units, personal digital assistants (PDAs), game consoles, electronic entertainment devices, and hubs. USB devices may include, but are not limited to keyboards, mice, displays, printers, scanners, camera, electronic entertainment devices such as digital audio devices, removable drives, etc.

An external device with USB capability has at least one USB plug. Generally, the USB plug is configured to mate with the host via a host-side USB socket (i.e., receptacle) using friction force. To facilitate discussion, FIG. 1 shows an example of a USB plug and socket. On a USB plug 100, a rectangular metal housing 102 has holes 104 located on the wide side of metal housing 102. Located inside metal housing 102 are plug pins 106, which reside a surface of substrate 108 (i.e., the downward-facing surface due to the orientation of the USB plug in FIG. 1).

On a USB socket 110, receptacle shell 112 has leaf springs 114 located on the wide side of a rectangular receptacle shell 112. At the end of each leaf spring 104 is a tip 116, which is designed to engage with a hole 104 when plug 100 is fully inserted into socket 110. The contact point may also be elsewhere, such as on a bend on the leaf spring. Inside receptacle shell 112 are socket pins 118 residing on a substrate 120. Socket pins 118 are configured to mate with plug pins 106 when USB plug 100 is inserted into USB socket 110.

Friction force allows USB plug 100 to stay mated with USB socket 110. Friction force is created when socket pins 118 make contact with plug pins 106. Friction force is also produced when leaf springs 114 slides along metal housing 102. Yet another source of friction force occurs when tips 116 are lodged inside holes 104.

A USB plug may be protected from environmental damage by capping it with a USB cap. A USB cap may be made of plastic or rubber or a similarly suitable material, typically without a metallic receptacle shell. The USB cap generally relies on friction to keep the cap engaged with the USB plug tip.

It has been found that friction force alone is insufficient in keeping some USB devices connected to their USB hosts or USB caps. If the USB device is not securely connected to the USB host, the USB device may be easily disconnected unintentionally, e.g., when the USB host and USB device combination is accidentally bumped. If the USB device is intended to be a portable device, the USB device may be inadvertently separated from its USB cap or from its USB host when subjected to movement, for example. In either of the above examples, the result is an unintended and undesirable separation and/or possible loss and/or damage to the USB host, the USB device, or both.

SUMMARY OF INVENTION

The invention relates, in an embodiment, to a Universal Serial Bus socket-equipped arrangement (USB-SEA) configured for mating with a Universal Serial Bus (USB) plug having a plug metal housing and an aperture disposed in the plug metal housing. The arrangement includes a plug-receiving cavity configured to receive the USB plug. The arrangement further includes a spring-loaded mechanism disposed within the plug-receiving cavity. The spring-loaded mechanism is biased toward an interior region of the plug-receiving cavity. The spring-loaded mechanism is also configured to slide along the connector metal housing of the USB plug when the USB plug is inserted into the plug-receiving cavity and to movably mate with the aperture disposed in the plug metal housing when the USB plug is in a terminal mating position with the USB socket assembly. The spring-loaded mechanism represents one of a spring-loaded ball and a spring-loaded pin.

In yet another embodiment, the invention relates to a Universal Serial Bus (USB) coupling arrangement. The arrangement includes a portable USB device having a USB plug. The USB plug has therein a plurality of plug pins. The USB plug also includes a plug metal housing surrounding the plurality of plug pins, at least one surface of the plug metal housing having therein an aperture. The arrangement further includes a USB socket-equipped arrangement (USB-SEA) having therein a plug-receiving cavity. The plug-receiving cavity includes a spring-loaded mechanism configured to bias against the plug metal housing. The spring-loaded mechanism represents one of a spring-loaded ball and a spring-loaded pin. Further, the spring-loaded mechanism is configured to slide along the plug metal housing when the USB plug is inserted into the plug-receiving cavity and to movably mate with the aperture disposed in the plug metal housing when the USB plug is in a terminal mating position with the plug-receiving cavity.

In yet another embodiment, the invention relates to a Universal Serial Bus (USB) coupling arrangement. The arrangement includes a USB plug having therein a plurality of plug pins. The USB plug includes a plug metal housing surrounding the plurality of plug pins. The plug metal housing includes a pair of first parallel surfaces and a pair of second parallel surfaces disposed perpendicular to the first parallel surfaces. The surface of the pair of second parallel surfaces is smaller than a surface of the pair or first parallel surfaces. At least one surface of the pair of second parallel surfaces has therein an aperture. The arrangement further includes a USB socket-equipped arrangement (USB-SEA) having therein a plug-receiving cavity. The plug-receiving cavity includes at least a first generally curved protrusion that is spring-loaded to bias against the plug metal housing. The first generally curved protrusion is configured to slide along the plug metal housing when the USB plug is inserted into the plug-receiving cavity and to movably mate with the aperture disposed in the plug metal housing when the USB plug is in a terminal mating position with the plug-receiving cavity.

In yet another embodiment, the invention relates to a portable electronic system. There is included a portable electronic device having a first plug, the first plug having therein a plurality of plug pins. The first plug includes plug housing surrounding the plurality of plug pins, at least one surface of the plug housing having therein an aperture. There is further included a first socket-equipped arrangement (SEA) having therein a plug-receiving cavity. The plug-receiving cavity includes a spring-loaded mechanism configured to bias against the plug housing. The spring-loaded mechanism is one of a spring-loaded ball and a spring-loaded pin. The spring-loaded mechanism is configured to slide along the plug housing when the first plug is inserted into the plug-receiving cavity and to movably mate with the aperture disposed in the plug housing when the first plug is in a terminal mating position with the plug-receiving cavity.

These and other features of the present invention will be described in more detail below in the detailed description of various embodiments the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF VARIOUS EMBODIMENTS

Figure 1:
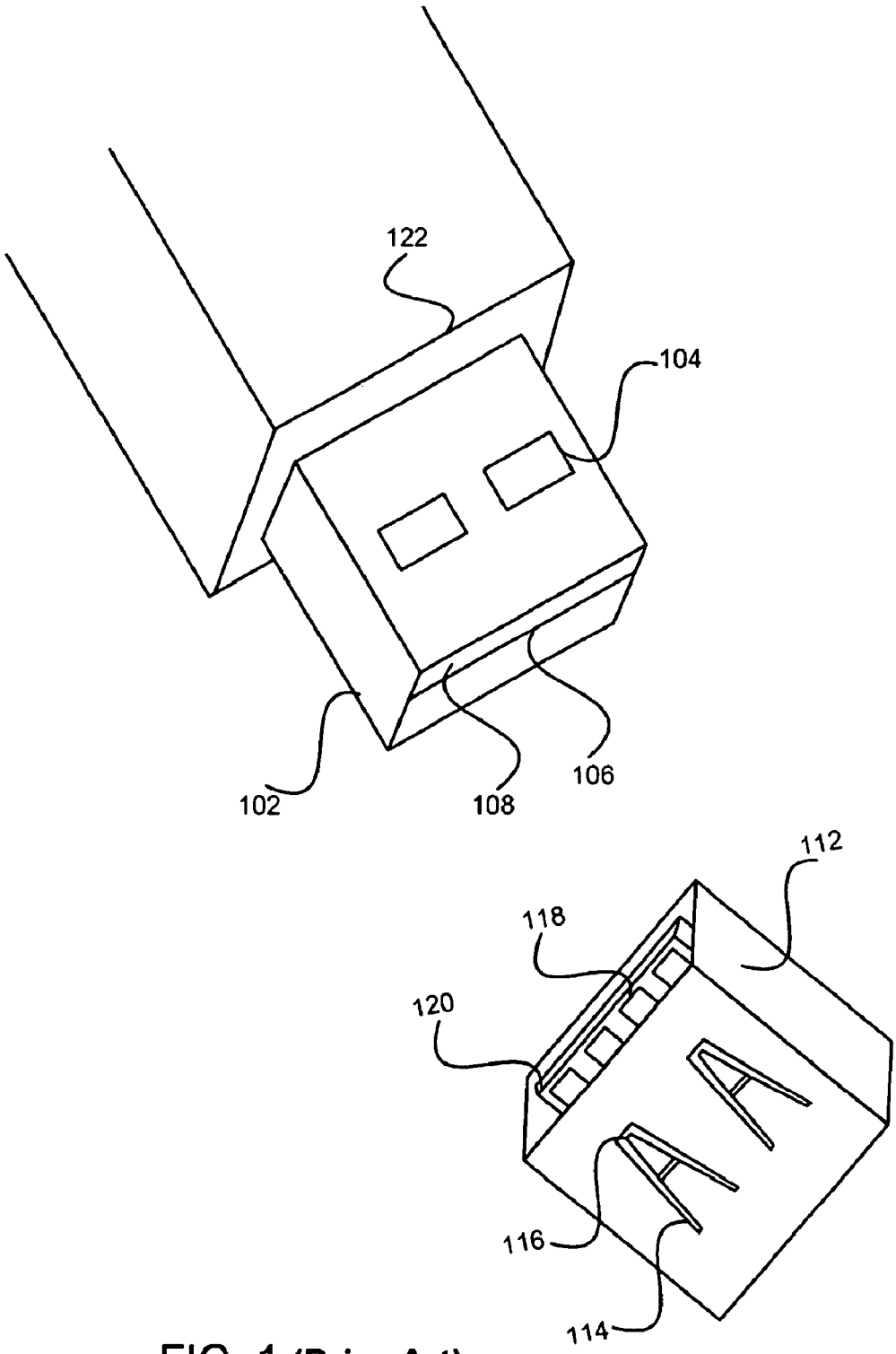
FIG. 1 (Prior Art)
FIG. 1 shows an example of a prior art Universal Serial Bus (USB) plug and socket.

The present invention will now be described in detail with reference to various embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described hereinbelow, including methods and techniques. It should be kept in mind that the invention might also cover articles of manufacture that includes a computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out tasks pertaining to embodiments of the invention. Examples of such apparatus include a general purpose computer and/or a dedicated computing device when appropriately programmed and may include a combination of a computer/computing device and dedicated/programmable circuits adapted for the various tasks pertaining to embodiments of the invention.

In accordance with embodiments of the present invention, there are provided more secure coupling arrangements between a Universal Serial Bus (USB) plug and a USB socket-equipped arrangement (USB-SEA). The USB plug is provided with at least one aperture, which is configured to mate with a generally curved protrusion located in the plug-receiving cavity of the USB-SEA.

As the term is employed herein, a USB socket-equipped arrangement (USB-SEA) may include any USB host that can save, recall, transfer, and/or process data. Beside electronic systems traditionally thought of as a USB host, a USB device may be plugged into other USB socket-equipped arrangements (USB-SEAs). For example, a battery pack, while not typically thought of as a USB host, may nevertheless have a USB socket to allow a USB device to obtain battery energy therefrom. As another example, a USB battery charger, while not typically thought of as a USB host, may nevertheless have a USB socket to supply electrical charge to a rechargeable battery within the USB device.

As another example, a display (such as a portable or stationary display employing liquid crystal display technology or other display technologies) may have a USB socket to enable the display to display data received from the USB device. As another example, a storage device (such as a portable or stationary storage device employing hard disks or other storage technologies) may have a USB socket to enable the storage device to store data received from the USB device or to enable the storage device to furnish data to the USB device. As another example, a remote control arrangement may include a first portion having a USB socket for mating with the USB plug of the USB device. The remote itself may communicate with this first portion using a signal-carrying wire or via a wireless approach. In these cases, power and/or signals (e.g., control, audio, video, data, etc.) are communicated between the USB-SEA and the USB device via one or more of the socket pins and one or more of the plug pins.

As another example, a cap having a USB-like socket may be employed to protect the plug and the plug pins from environmental damage. Thus, a USB-SEA may include all the above examples and other arrangements having a plug-receiving cavity configured to mechanically and/or electronically mate with a USB plug.

A USB-SEA may be either stationary or portable (e.g., capable of being carried or worn by the human user). Given the rising popularity of portable USB entertainment and/or communication devices (such as the popular iPOD™ devices, available from Apple Computer, Inc. of Cupertino, Calif.), a USB-SEA, such as a USB cap, oftentimes includes a lanyard to allow the user to wear the USB device when the USB device is plugged into the USB-SEA.

The plug-receiving cavity of the USB-SEA may represent a USB socket having a rectangular metallic housing and a socket pin-bearing substrate. The plug-receiving cavity of the USB-SEA may also represent, for example, the recess in a USB cap into which the USB plug may be inserted. In the case of the USB cap, there may be no metallic housing and/or socket pins as called for by the industry-standard USB electrical and mechanical specification.

The generally curved protrusion is designed to easily accommodate the initial insertion of the USB plug tip and to slide along the metal housing of the USB plug prior to positively engaging with the aperture. Further, the generally curved protrusion is biased against the metal housing of the USB socket by a biasing means, such as a coil spring. Since different coil springs can be manufactured with different biasing forces, it is possible for a USB socket to accommodate different USB devices simply by replacing one coil spring with another coil spring to achieve a higher or lower engaging/disengaging force.

When the generally curved protrusion couples with the aperture, a positive tactile feedback is provided. The positive tactile feedback provides the user with a secure feeling that the USB plug and USB-SEA is fully engaged and the generally curved protrusion of the USB-SEA has positively engaged with the aperture in the metal housing of the USB plug.

In an embodiment of the invention, the distance between the USB plug aperture that accepts the generally curved protrusion of the USB-SEA and the start of the plug overmold portion (i.e., the rubber or plastic molding that can be grasped by the user) is matched with the distance between the generally curved protrusion of the USB-SEA and opening of the plug-receiving cavity of the USB-SEA so that when the USB plug is fully inserted into the USB-SEA and the aperture in the USB plug engages the generally curved protrusion in the USB-SEA, there is visually substantially no gap between the start of the plug overmold portion of the USB plug and the opening of the plug-receiving cavity of the USB-SEA. The closing of this gap provides a visual confirmation that the USB plug is securely mated with the USB-SEA.

In an embodiment, no external collar arrangement is required on or near the socket to retract the generally curved protrusion in order to facilitate insertion and full engagement of the USB plug and the USB-SEA. This feature enhances user-friendliness since there may be no space on or around the USB-SEA to accommodate an external collar. Even if there is space, such a collar may be too small and uncomfortable for users with large fingers. In an embodiment, the retraction of the generally curved protrusion (e.g., steel ball) is automatic upon insertion of the USB plug into the USB-SEA and such automatic retraction is sufficient to allow the full engagement of the USB plug and the USB-SEA when the USB plug is in its terminal coupling position. Further, the retraction of the generally curved protrusion (e.g., steel ball) from the aperture on the plug is automatic upon pulling the USB plug apart from the socket on the USB-SEA. In other words, no collar manipulation is required, other than pulling the plug apart from the socket, to separate the USB plug from the socket. Once the generally curved protrusion is dislodged from the plug aperture, the generally curved protrusion may slide along the plug housing until the USB plug and the socket are apart.

Figure 2:
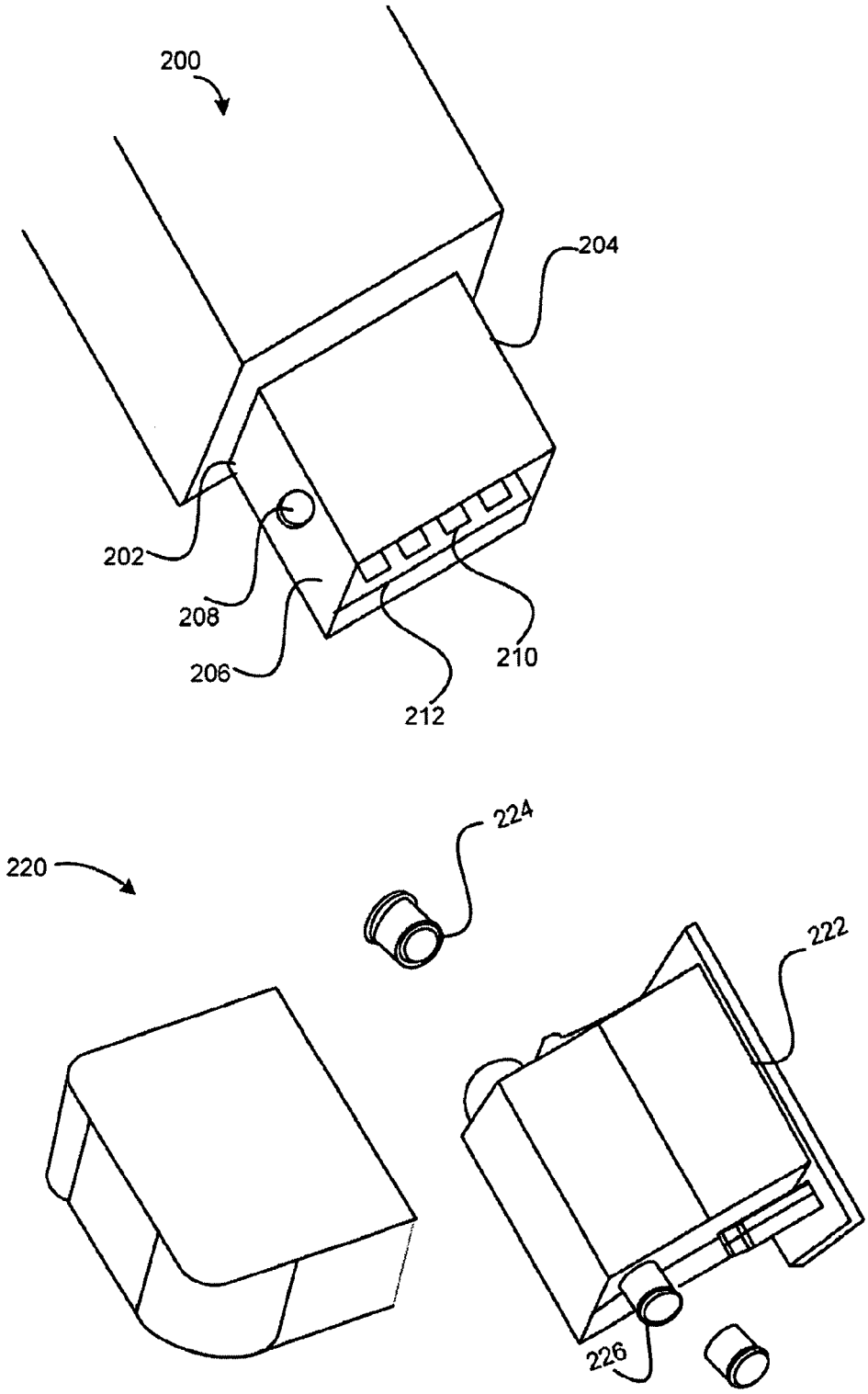
FIG. 2 shows, in accordance with an embodiment of the present invention, a USB cap, representing one type of USB socket equipped arrangement (USB-SEA), along with a modified USB plug configured to movably mate with a coupling mechanism in the cap.

The features and advantages of embodiments of the invention may be better understood with reference to the figures and discussions that follow. FIG. 2 shows, in accordance with an embodiment of the present invention, a USB plug and a USB cap, with the USB cap representing one type of USB-SEA. On USR plug 200, a metal housing 202 comprises of two pairs of parallel surfaces. A first pair of parallel surfaces 204 is perpendicular to a second pair of parallel surfaces 206. Located on at least one side of the second pair of parallel surfaces 206 is an aperture (i.e., retention hole) 208. Preferably, there are two apertures 208, one on each of the two parallel surfaces 206. Located inside metal housing 202 are plug pins 2110, which reside on top of a substrate 212.

On a USB cap 220, inner cap 222 has a cavity 226. A ball detent assembly 224 houses a coil spring and a steel ball, with the coil spring biasing the steel ball in the direction into the plug-receiving cavity of the USB-SEA. Ball detent assembly 224 is essentially a tube with one closed end and a constricted open end that is designed to snugly capture the steel ball in a position such that at least a portion of the steel ball protrudes from the open end of the ball detent assembly. This arrangement is shown in greater detail in FIG. 3 herein.

Figure 3:
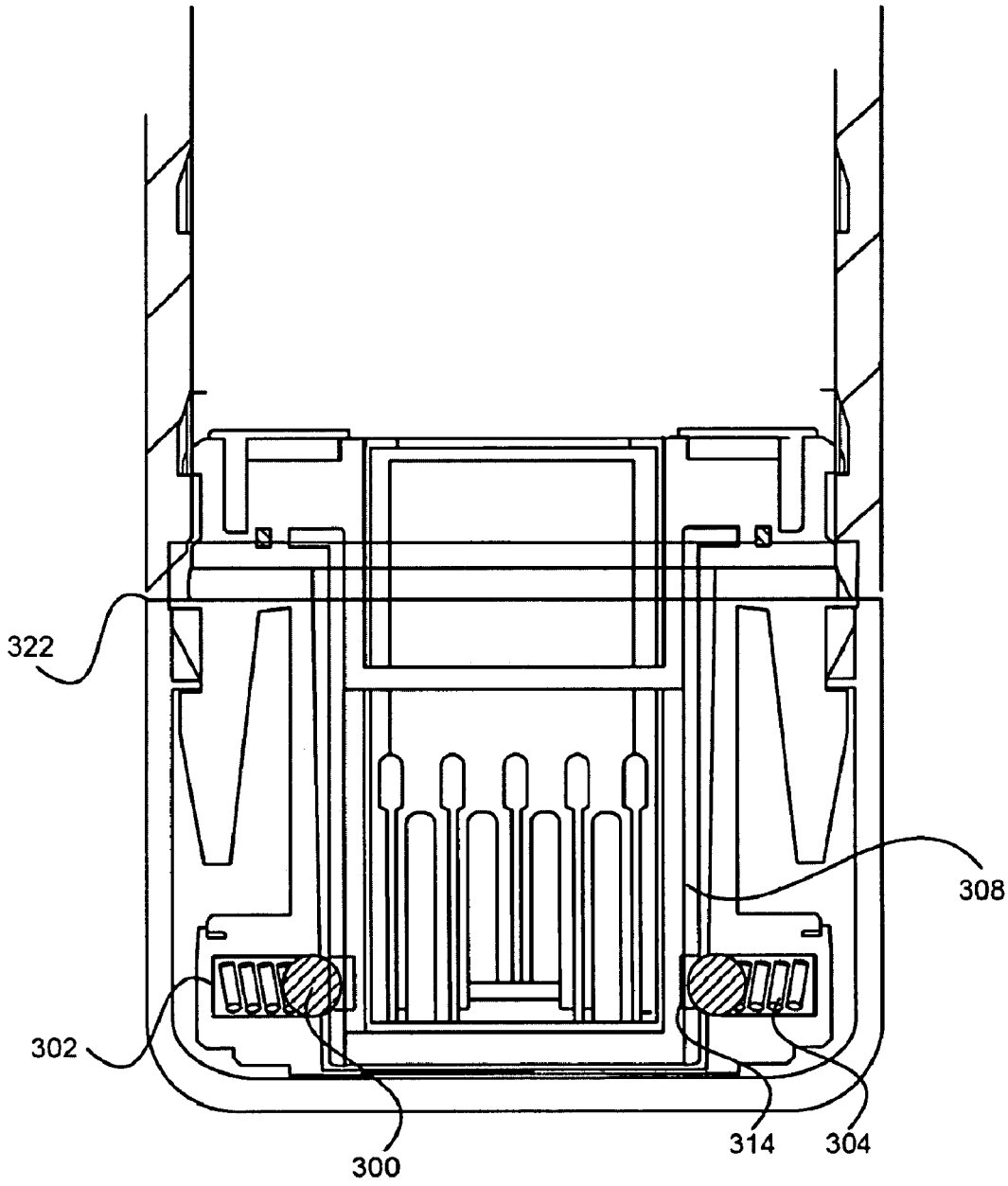
FIG. 3 shows, in accordance with an embodiment of the invention, how the steel balls of the detent assemblies of the USB-SEA engage apertures in the USB plug housing.

The coil spring is disposed inside the tube. Since the constricted end is dimensioned to snugly capture the steel ball, the steel ball may be press-fitted into position during manufacturing. Ball detent assembly 224 may be ultrasonically welded into cavity 226 in inner cap 222. There are other ways that ball detent assembly 224 may be coupled with cavity 226. These methods may include, but are not limited to, glued in, pressed in, heat-processed, heat-sinked, etc. In a preferred embodiment, there are two ball detent assemblies 224, one on each side of inner cap 222. FIG. 3 shows, in an embodiment of the invention, how the steel balls of the detent assemblies engage apertures in the USB plug housing. In FIG. 3, a steel ball 300 is disposed inside a detent assembly 302. Detent assembly 302 includes a coil spring 304 that pushes against a ball 306. In the embodiment of FIG. 3, steel ball 300 represents a generally curved protrusion for engaging with a corresponding aperture in the USB plug housing, and coil spring 304 represents a biasing mechanism for biasing the generally curved protrusion against the USB plug housing when the USB plug is inserted into the plug-receiving cavity in the USB-SEA.

Generally, spring-loaded ball 300 is configured to bias toward the interior region of the plug receiving cavity and against a plug metal housing 308 when the USB plug is inserted into the plug-receiving cavity of the USB-SEA. Thus, when the USB plug is inserted into the USB-SEA, plug metal housing 308 causes ball 300 to travel outward (e.g., retracts) and compress against coil springs 304. The amount of pressure that ball 300 exerts against coil spring 304 lessens when ball 300 mates with aperture 310 in metal housing 308 of the USB plug. The transition by ball 300 from a sliding motion along the metal housing surface of the plug to a snapping motion as ball 300 engages with the aperture in the plug metal housing creates a human-perceptible tactile sensation or human-perceptible sound. This human-perceptible tactile sensation or sound advantageously confirms, in a positive manner, to the user that a definitive engagement between the USB plug and the USB-SEA has been achieved.

Most advantageously, once ball 300 snaps into aperture 310 of the USB plug housing, a significant amount of force is required to disengage the USB plug from the USB-SEA since the disengaging force must compress the spring sufficiently to allow ball 300 to "slide out" of its rested position inside aperture 310. It should be appreciated that the amount of disengagement force is configurable by simply selecting the appropriate biasing device (e.g., the coil spring) that provides the desired biasing force.

FIG. 3 also shows that once the USB plug is in the terminal mating position with the plug-receiving cavity of the USB-SEA, there is substantially no gap between the overmold portion of the USB plug and the opening of the plug-receiving cavity of the USB-SEA. The closure of the gap (shown in FIG. 3 by reference number 322) is achieved by designing the USB plug tip, the USB plug overmold, the aperture in the USB plug metal housing, the depth of the plug-receiving cavity of the USB-SEA, and location of the biasing ball with the appropriate dimensions. This closure advantageously provides a positive visual feedback to the user that positive engagement has taken place.

In an embodiment of the invention, ball 300 may be located on each side of plug-receiving cavity of the USB-SEA. Further, aperture 310 may be located on each side of plug metal housing 308. Thus, when the USB plug is inserted into the plug-receiving cavity of the USB-SEA, the ball on each of the plug-receiving cavity of the USB-SEA mates with the aperture located on each side of the plug metal housing.

Note that the balls in the plug-receiving cavity of the USB-SEA and their corresponding apertures in the USB plug housing are alternatives to, or preferably additions to, the prior art leaf springs/tips and corresponding holes (e.g., leaf springs 104/tips 106 and corresponding holes 104 of FIG. 1). Accordingly, the combination of ball 300/aperture 310 increases the force requires to disengage the USB from its USB-SEA. In the case where the USB-SEA does not have a metal housing (such as in a USB cap, for example), the biasing ball/corresponding aperture combination not only replaces the prior art leaf spring/tip and corresponding hole but further allows the plug-receiving cavity of USB-SEA to be formed of any material, even resilient materials such as soft plastic or hard rubber since the function of positively engaging the apertures in the plug metal housing is provided by the biasing ball and not by leaf spring/lip molded from the same material that forms the plug-receiving cavity of the USB-SEA. Still further, the use of a removable (i.e., not integrally molded) biasing arrangement, such as coil spring 304 allows the manufacturer to employ different coil springs to achieve different biasing force.

Accordingly, it is possible to tailor the tactile/audible feedback to the customer's specification, as well as to tailor the amount of force required to engage/disengage the USB plug from the USB-SEA simply by employing different springs having different amounts of biasing force. This customization ability would not have been possible had the biasing mechanism been integral (i.e., hence non-customizable) with the plug-receiving cavity of the USB-SEA, such as the case when the prior art leaf spring/tip is formed integral with the metal housing of the USB socket. This customization ability also would not have been possible had the biasing mechanism been non-replaceable, such as the case with any aperture-engaging nub or spring that is integrally formed with the plug-receiving cavity of the USB-SEA. Using embodiments of the present invention, the manufacturer of the USB-SEA now has the ability to configure the same USB-SEA to handle different USB devices by simply selecting different springs during the manufacturing process.

Figure 4:
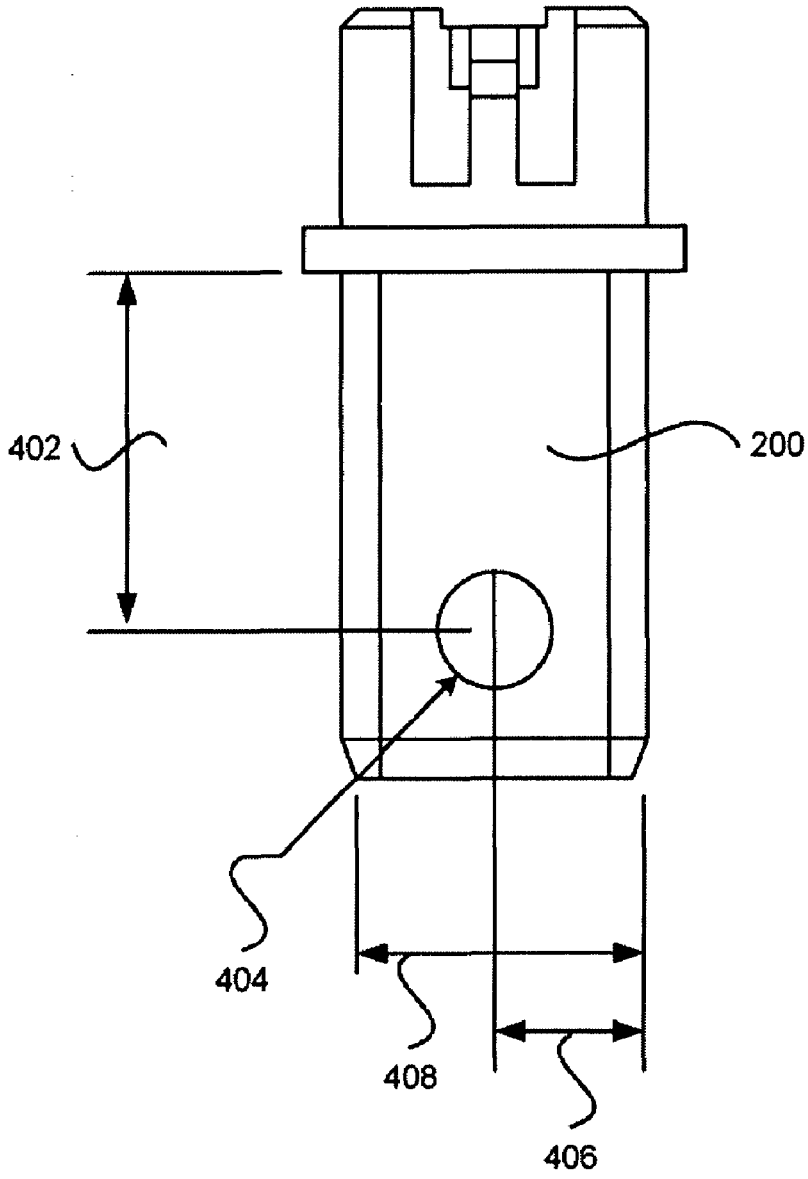
FIG. 4 shows, in accordance with an embodiment of the invention, example dimensions of the USB plug, including the ball-receiving aperture.

The next two figures provide the dimensions for the new USB plug and USB socket. FIG. 4 shows, in an embodiment of the invention, example dimensions of the USB plug, including the ball-receiving aperture. Distance 402, which is the distance from start of the overmold portion of the USB plug to the center of the aperture, is about 9.96 millimeter with a tolerance of about 0.05 millimeter. Distance 404, which is the diameter of the aperture, is about 1.60 millimeter with a tolerance of about 0.10 millimeter. Distance 406, which is the thickness of the USB plug (i.e., the distance between the two wider parallel surfaces of the plug metal housing), is about 4.50 millimeter with a tolerance of about 0.05 millimeter. Distance 408, which is the distance from the center of the aperture to one of the wider parallel surfaces of the USB plug metal housing, is about 2.25 millimeter with a tolerance of about 0.05 millimeter.

Figure 5:
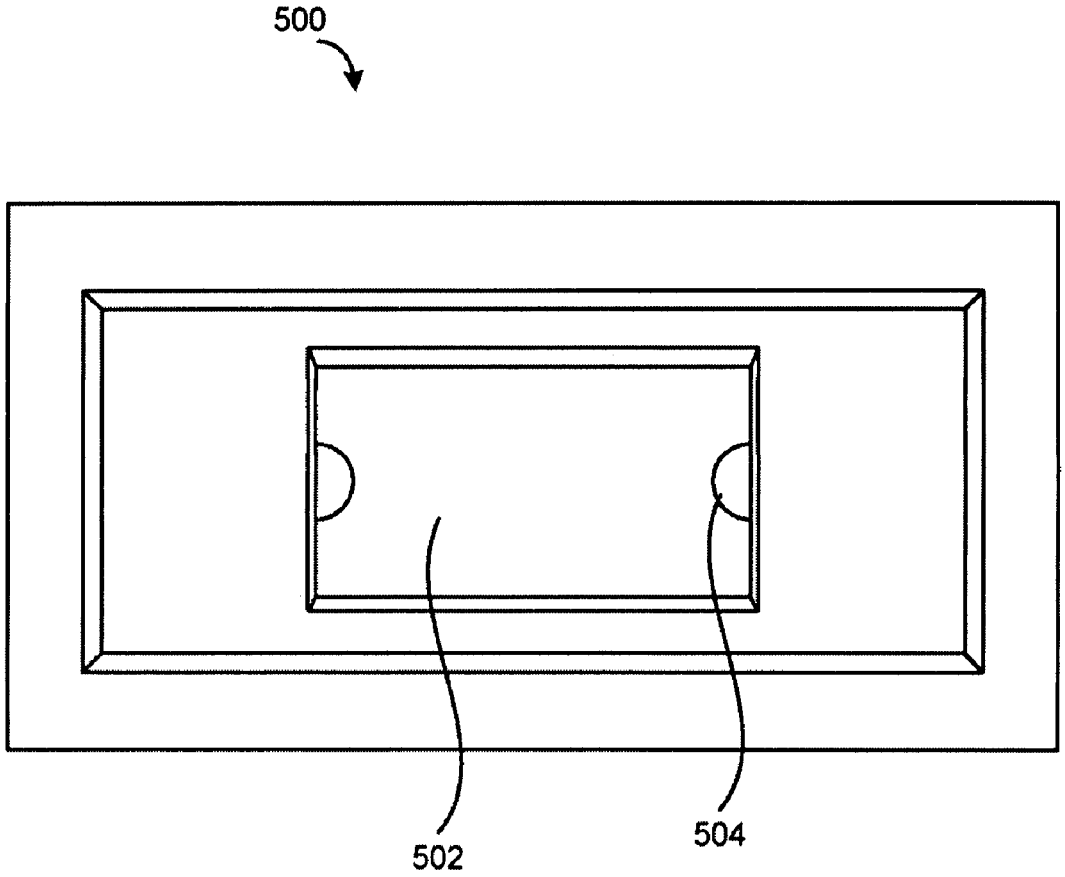
FIG. 5 shows, in accordance with an embodiment of the invention, a view of the plug-receiving cavity of a cap 500, representing an example a USB-SEA.

FIG. 5 shows, in an embodiment of the invention, a view of the plug-receiving cavity of a cap 500, representing an example USB-SEA. The view of FIG. 5 is directly into the plug-receiving cavity, from the direction of USB plug insertion. Plug-receiving cavity 502 may be formed of any suitable material and is dimensioned to snugly fit the USB plug metal housing. Ball 504 is about 2 millimeter in diameter with a 0.5 millimeter protrusion inside the plug-receiving cavity. The ball 504 may be made of highly polished stainless steel and/or may have a different dimension depending on applications.

There are many ways to apply the coupling arrangements disclosed in embodiments of the invention. For an example, in an embodiment of the invention, the USB plug may be part of an electronic entertainment device, which is configured to play electronically stored music (i.e., MP3 player). The USB plug may mate with a USB cap that may be coupled to a lanyard. This coupling arrangement allows the user to wear the USB electronic entertainment device around his neck, via the lanyard cap, without fear of unexpected disengagement.

In an embodiment of the invention, the electronic entertainment device may mate with a plug-receiving cavity that is coupled to a human attachment arrangement. The human attachment arrangement (i.e., armband) is configured to be worn by the user. Thus, the user may insert the electronic entertainment device into the armband and proceed to enjoy the electronic entertainment device without fearing that the electronic entertainment device might inadvertently become disengaged from the armband through normal activities. For example, a runner can enjoy listening to his favorite songs playing on an MP3 player, which is attached to an armband, without worrying that the MP3 player may accidentally become disengaged.

In an embodiment of the invention, the USB plug may be part of an electronic image-capturing device (i.e., pen scanner). Similar to the electronic entertainment device, the electronic image-capturing device may be connected to a USB socket, which may be part of a lanyard cap or a human attachment arrangement (i.e., armband). In either case, the user may insert the electronic image-capturing device into the USB socket without fearing that the electronic image-capturing device may unintentionally disengage from the USB socket.

Figure 6:
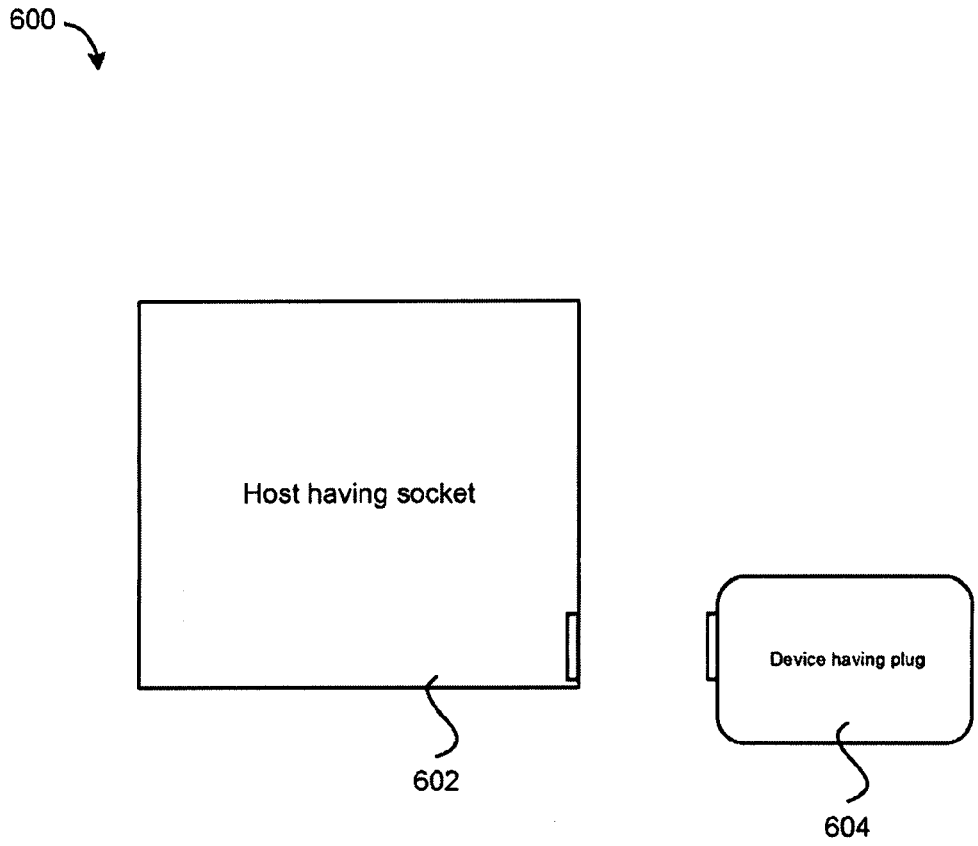
FIG. 6 shows, in accordance with an embodiment of the invention, an inventive electronic system that includes a host having a socket and a device having a plug, the host having a socket being coupled with the device having a plug using the generally curved detent mechanism and the plug aperture disclosed herein.

FIG. 6 shows, in accordance with an embodiment of the invention, an inventive electronic system that includes a host having a socket and a device having a plug, the host having a socket being coupled with the device having a plug using the generally curved detent mechanism and the plug aperture disclosed herein. The host having a socket may represent any electronic or electrical sub-system (e.g., a display, an external hard disk, an external storage device, a battery pack, a charger, etc.) The device having a plug may represent any electronic or electrical sub-system (e.g., a portable audio player, a portable video player, a portable memory device, etc.) that is configured to be coupled to the host via the plug and the socket. As mentioned, the plug and the socket are endowed with apertures and detent mechanisms in the manner discussed herein. Note that although the preferred or disclosed embodiment refers to the USB plug and the USB socket, it is possible that the plug and socket may be configured for use with other protocols.

Advantages offered include a more secure method of keeping the USB plug mated with the USB-SEA and improved tactile/visual feedback of the positive engagement. As mentioned, embodiments of the invention offer more secure mating arrangements and requires a greater disengagement force to disengage the USB plug from the plug-receiving cavity of the USB-SEA. Since the biasing mechanism (e.g., the coil spring) may be selected to suit the biasing and disengagement force requirements of a particular application, embodiments of the present invention allows the manufacturer to efficiently customize a USB-SEA to a variety of USB devices. Additionally, the positive "snapping" action of the ball into its corresponding aperture as the USB plug is fully inserted into the plug-receiving aperture offers a positive tactile and/or audible feedback to the user, giving the user a heightened sense of confidence that positive engagement has taken place. Still further, the closure of the gap between the plug overmold and the opening of the plug-receiving cavity of the USB-SEA provides a positive visual feedback to the user that positive engagement has taken place.

While this invention has been described in terms of several embodiments, there are alterations, permutations, and equivalents, which fall within the scope of this invention. For example, although the generally curved protrusion is disclosed in the specific example as a steel ball, such generally curved protrusion may be formed of any suitably hard material, including various metals and plastics. Further, the generally curved protrusion may not be balls at all. As long as the mechanism that engages the aperture has a sloped surface (which may be concave or convex) to allow a force pulling the USB plug and the USB-SEA apart to "slide" the mechanism out of the aperture, positive engagement and disengagement in accordance with principles of the present invention are achieved. For example, a pin with a rounded end may be employed in place of the ball.

As a further example, the biasing mechanism can be any alternative to a coil spring, such as a removable leaf spring, that provides a biasing force to the generally curved protrusion. As a further example, the biasing mechanism does not need to be disposed in the detent mechanism of FIG. 3. As long as the biasing mechanism and the generally curved protrusion are attached to the USB-SEA in some way to allow the generally curved protrusion to engage with the aperture in the USB plug housing, positive engagement and disengagement in accordance with principles of the present invention are achieved.

As a further example, the generally curved protrusion may be made of a suitable non-metallic material if desired. As another example, the metal housing surrounding the plug pins may be replaced by another suitable non-metallic housing. As a further example, the mechanism for positively coupling the plug to the socket (and by extension, the plug-including sub-system to the socket-including sub-system) may be applied to plugs and sockets adapted for use with protocols other than the USB protocol. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A Universal Serial Bus socket-equipped arrangement (USB-SEA) configured for mating with a USB plug having a plug metal housing and at least an aperture disposed within the plug metal housing, comprising:

a plug-receiving cavity configured to receive the USB plug; and a ball detent assembly disposed within the plug-receiving cavity, the ball detent assembly is configured to include a tube with a closed end and a constricted open end, wherein the ball detent assembly is further configured to include a coil spring and a generally curved protrusion, the coil spring representing a biasing mechanism for biasing the generally curved protrusion against the plug metal housing when the USB plug is inserted into the plug-receiving cavity of the USB-SEA.

2. The USB-SEA of claim 1 wherein the ball detent assembly is configured to impart a human-perceptible tactile sensation when the generally curved protrusion transitions from sliding along the surface of the plug metal housing of the USB plug to mate with the aperture.

3. The USB-SEA of claim 1 wherein the USB plug is coupled to a portable electronic entertainment device.

4. The USB-SEA of claim 1 wherein the aperture is disposed on each side of the plug metal housing, the aperture being configured to mate with the ball detent assembly disposed on each side of the plug-receiving cavity when the USB plug is inserted into the USB-SEA.

* * * * *